US012037712B2

(12) United States Patent
Czaja et al.

(10) Patent No.: US 12,037,712 B2
(45) Date of Patent: Jul. 16, 2024

(54) BACTERIAL DERIVED NANOCELLULOSE TEXTILE MATERIAL

(71) Applicant: DePuy Synthes Products, Inc., Raynham, MA (US)

(72) Inventors: Wojciech Czaja, Downingtown, PA (US); Erica Shwarz, Philadelphia, PA (US); Darric Inselman, Chester Springs, PA (US)

(73) Assignee: DePuy Synthes Products, Inc., Raynham, MA (US)

( * ) Notice: Subject to any disclaimer, the term of this patent is extended or adjusted under 35 U.S.C. 154(b) by 738 days.

(21) Appl. No.: 16/844,142

(22) Filed: Apr. 9, 2020

(65) Prior Publication Data

US 2020/0325600 A1 Oct. 15, 2020

Related U.S. Application Data

(60) Provisional application No. 62/832,311, filed on Apr. 11, 2019.

(51) Int. Cl.

| | |
|---|---|
| ***D01F 2/00*** | (2006.01) |
| ***D01F 11/02*** | (2006.01) |
| ***D04H 1/4258*** | (2012.01) |
| ***D04H 1/4382*** | (2012.01) |
| ***D06M 13/224*** | (2006.01) |
| ***D06M 101/06*** | (2006.01) |

(52) U.S. Cl.

CPC ..... *D01F 2/00* (2013.01); *D01F 11/02* (2013.01); *D04H 1/4258* (2013.01); *D04H 1/43838* (2020.05); *D06M 13/2243* (2013.01); *D06M 2101/06* (2013.01)

(58) Field of Classification Search

CPC ..... D01F 2/00; D01F 11/02; D04H 1/43838; D04H 1/4258; D06M 13/2243; D06M 2101/06

USPC ..... 536/1.11

See application file for complete search history.

(56) References Cited

U.S. PATENT DOCUMENTS

| | | | |
|---|---|---|---|
| 3,757,428 | A | 9/1973 | Runciman |
| 4,788,146 | A | 11/1988 | Ring et al. |
| 5,207,826 | A | 5/1993 | Westland et al. |
| 2005/0042263 | A1 | 2/2005 | Damien et al. |
| 2010/0158985 | A1 | 6/2010 | Serafica et al. |
| 2013/0224278 | A1 | 8/2013 | Czaja et al. |
| 2015/0183708 | A1 | 7/2015 | Harris et al. |
| 2015/0225486 | A1 | 8/2015 | Hessler et al. |
| 2016/0200602 | A1 | 7/2016 | Unbehaun et al. |
| 2018/0148890 | A1 | 5/2018 | Brown, Jr. et al. |
| 2019/0024303 | A1 | 1/2019 | Lee et al. |
| 2019/0093288 | A1 | 3/2019 | Mason et al. |

FOREIGN PATENT DOCUMENTS

| | | | | |
|---|---|---|---|---|
| AU | 2011300350 | B2 * | 1/2015 | ..... B82Y 30/00 |
| CN | 103980526 | A | 8/2014 | |
| CN | 103980526 | A * | 8/2014 | |
| CN | 104271166 | A | 1/2015 | |
| CN | 106087451 | A | 11/2016 | |
| CN | 108797142 | A | 11/2018 | |
| EP | 2816006 | A1 | 12/2014 | |
| GB | 191502633 | A | 7/1915 | |
| GB | 0661176 | A | 11/1951 | |
| GB | 1325676 | A | 8/1973 | |
| JP | 49-041505 | A | 4/1974 | |
| JP | 58-036260 | A | 3/1983 | |
| JP | 08-301902 | A | 11/1996 | |
| JP | 2009-077752 | A | 4/2009 | |
| JP | 2013-522399 | A | 6/2013 | |
| JP | 2015-504845 | A | 2/2015 | |
| WO | 89/12107 | A1 | 12/1989 | |
| WO | 2010/031154 | A2 | 3/2010 | |
| WO | 2012/071578 | A2 | 5/2012 | |
| WO | 2013/094077 | A1 | 6/2013 | |
| WO | WO-2016029432 | A1 * | 3/2016 | ..... C12P 19/04 |
| WO | WO-2016113400 | A1 * | 7/2016 | ..... A61L 15/28 |
| WO | 2020/058836 | A1 | 3/2020 | |

OTHER PUBLICATIONS

Hubbe et al ( "Nanocellulose in Thin Films, Coatings, and Plies of Packaging Applications: A Review", BioResources 12(1) 2143-2233, 2017). (Year: 2017).*

Karina et al. Effect of Castor Oil Impregnation on the Physical and Mechanical Properties of Bacterial Cellulose. Polymers from Renewable Resources, vol. 3, No. 1, pp. 13-26, 2012. (Year: 2012).*

Zhang et al., Progress on Study of Bacterial Cellulose Nanocomposite, Synthetic Fiber in China, No. 01, Jan. 25, 2010, 1-29.

"Synthesis of Takai Kazuo", microbial cellulose and it's use, vol. 48, No. 4, 1992, pp. 9-13 (with English Translation).

* cited by examiner

*Primary Examiner* — Yih-Horng Shiao

(74) *Attorney, Agent, or Firm* — BakerHostetler

(57) ABSTRACT

The present disclosure is directed to an oil-infused bacterial nanocellulose (BNC) material including a porous body comprising a three-dimensional network of bacterial nanocellulose fibers defining a plurality of interconnected pores; and, an oil infused within the plurality of pores. The present disclosure additionally describes a method of preparing an oil-infused BNC material that includes fermenting bacteria to form a porous body of bacterial nanocellulose fibers having a three-dimensional network defining a plurality of interconnected pores; mechanically pressing the porous body; dehydrating the porous body; and infusing the porous body with an oil infusion fluid including an oil so as to entrap the oil in the pores of the porous body forming an oil-infused BNC material.

29 Claims, 2 Drawing Sheets

BACTERIAL DERIVED NANOCELLULOSE TEXTILE MATERIAL

CROSS-REFERENCE TO RELATED APPLICATIONS

This application claims the benefit of U.S. Provisional Appl. No. 62/832,311, filed on Apr. 11, 2019, which is hereby incorporated by reference in its entirety.

FIELD OF DISCLOSURE

The present disclosure is directed to oil-infused bacterial nanocellulose materials for use as a fabrics and textiles and methods of manufacturing the same.

BACKGROUND

The leather industry is a greater than 100-billion-dollar industry that produces a unique textile material with desired physical and handling properties (when compared to other textile materials) through the mechanical and chemical treatment of animal hides and skins. The leather industry has grown at a rate that the demand for leather products outpaces the meat industry. Demand for animal meat is rising at a rate of approximately 3 percent, which closely reflects the growth rate of the human population, while demand for leather products is growing at a rate of 4-7%. Due to this increase of demand, leather material providers have had to look to other livestock to meet the growing demand for pelt material.

The tanning of leathers requires the consumption of large quantities of water, exposes workers to chemicals, and results in soil and water contamination, and the generation of significant amounts of organic wastes. For every ton (~1,000 kg) of hide material processed an estimated 200 kg of finished product is created. The remaining material is organic waste that currently has no commercial value.

While synthetic leather materials offer an alternative that is less impactful to the environment and livestock, synthetic leather suffers from poor handling properties, durability, and aesthetics that have made its adoption unsuccessful. While synthetic leather offers some properties that are superior to real leather textiles, its plastic-like quality and uniform appearance is perceived cheap and less favorable to the fashion industry, which prefers the random characteristics and textures provided by animal hides, which include the smell and feel of real leather.

Another complaint of the synthetic leather industry is that it is not a closed environmental process. While the leather tanning industry produces significant environmental impacts, it is generally accepted that leather products readily break down over time and biodegrade whereas synthetic leather products are not biodegradable and can release toxins, dioxins, and phthalates into the environment many years after their useful life. Many of the raw materials used in the production of synthetic leathers also have negative impacts on the environment when mined or pre-processed such as polyurethane, solvents, plasticizers, and polyvinyl chloride.

Moreover, not only is the durability of synthetic leather inferior to genuine leather, the nature of its wear is undesirable when compared with natural materials. Real leather material can actually become more desirable when it ages as it develops a worn patina and a softened texture. Synthetic, leather when worn out begins to delaminate and peal which is an undesirable aesthetic characteristic.

The current options available to the consumers of leather and faux leather products represents a complex tradeoff requiring compromising of values and quality. There is a void in the market for a natural material that does not require a compromise of ethics, environmental effects, and product performance.

SUMMARY

It would be beneficial to utilize a material for textile and fabric applications that reduces the environmental impact in harvesting of raw material, as well as the negative effects of both production and degradation, while maintaining an aesthetic quality that mimics the desirable attribute of natural leather.

Cellulose of various origins has been proven to be a versatile biomaterial for multiple applications. Synthesized by just about every type of plant and a select number of microorganisms, such as certain yeasts and bacteria, it is an all-natural, renewable, biocompatible, and degradable polymer used in a wide variety of applications including paper products, food, electronics, drug coatings, and bandages.

Cellulose formed from bacteria, i.e., bacterial nanocellulose (BNC), represents a naturally occurring material with high strength, conformability, and handling properties. Cellulose derived from bacteria forms a porous three-dimensional network of cellulose nanofibers that under certain conditions can simulate some of the physical and mechanical properties of natural hides (e.g., leather), such as grain texture and flexibility.

Accordingly, the present disclosure is directed to an oil-infused bacterial nanocellulose (BNC) material including a porous body having a three-dimensional network of bacterial nanocellulose fibers, where the nanocellulose fiber network defines a plurality of interconnected pores, and an oil infused within the plurality of pores.

In certain embodiments, the oil-infused BNC material comprises a porous body of never-dried bacterial nanocellulose. In certain embodiments, the porous body is pure BNC material. In certain additional embodiments, the porous body is fully dehydrated.

According to certain embodiments, the nanocellulose fibers have a crystallinity as measured by x-ray diffraction (XRD) of at least 65%. In certain embodiments, the porous body has a cellulose content in the range of about 20 mg/cm' to about 30 mg/cm'. In still other embodiments, the oil-infused BNC material has a thickness in the range of about 1 mm to about 10 mm.

According to some embodiments, the oil comprises at least 70% by weight of the total weight of the oil-infused BNC material. In still other embodiments, the oil comprises about 70% to about 95% by weight of the total weight of the oil-infused BNC material.

According to certain embodiments, the oil-infused BNC material has a tensile strength in the range of about 275 $N/cm^2$ to about 2100 $N/cm^2$. According to further embodiments, the oil-infused BNC material has a tensile load at failure value in the range of about 50 N to about 150 N. According to still further embodiments, the oil-infused BNC material has a stitch pullout failure load in the range of about 5 N to about 40 N.

According to certain embodiments, the oil-infused BNC material further includes one or more dyes or sealing agents.

According to the present disclosure, a textile or fabric material is described including the oil-infused BNC as previously detailed.

In certain embodiments, the textile or fabric material comprises a single sheet of oil-infused BNC. In certain further embodiments, the textile material comprises a plurality of sheets of oil-infused BNC; in other words, a multi-layer textile material of oil-infused BNC. In certain additional embodiments, the sheet can comprise a plurality of oil-infused BNC strips, strands, or fibers, or combinations thereof, that are woven or knitted or braided, or other known methods of interlacing or interconnection that are commonly known to those of skill in the art. In alternate embodiments, the oil-infused sheet is a continuous, uniform, monolithic structure.

The present disclosure additionally describes a method of preparing an oil-infused bacterial nanocellulose (BNC) material comprising the steps of:

fermenting bacteria to form a porous body of bacterial nanocellulose fibers having a three-dimensional network defining a plurality of interconnected pores;

mechanically pressing the porous body;

dehydrating the porous body;

infusing the porous body with an oil infusion fluid including an oil so as entrap the oil in the pores of the porous body so as to form an oil-infused BNC material.

According to certain embodiments the fermentation step includes fermenting at a temperature in the range of about 30° C.+/−2° C. According to additional embodiments, the fermentation step includes fermenting for a time period in the range of about 5 days to about 30 days. In certain embodiments, fermenting is done in at a pH in the range of about 4.1 to about 4.6. In certain embodiments, the method can include purifying the porous body after fermentation.

According to certain embodiments, dehydrating the porous body comprises using a solvent including one or more water-miscible organic solvents. In certain embodiments, the solvent is heated to boiling. In further embodiments, the weight to volume ratio in mg/ml of the nanocellulose fibers to the solvent can be in the range of about 15:1 to about 8:1.

According to certain embodiments, the oil infusion fluid is heated during the infusion step. According to further embodiments, the weight to volume ratio in mg/ml of the nanocellulose fibers to the oil infusion fluid is in the range of about 1:1 to about 1:10.

According to certain embodiments, the oil infusion fluid includes an emulsifier. In further embodiments, the emulsifier includes a water-miscible organic solvent. According to further embodiments, the oil infusion fluid has an oil to emulsifier ratio by volume in the range of about 90:10 to about 10:90.

According to further embodiments, the present method can further include a step of dying the oil-infused BNC material.

DETAILED DESCRIPTION

Figure 1A:
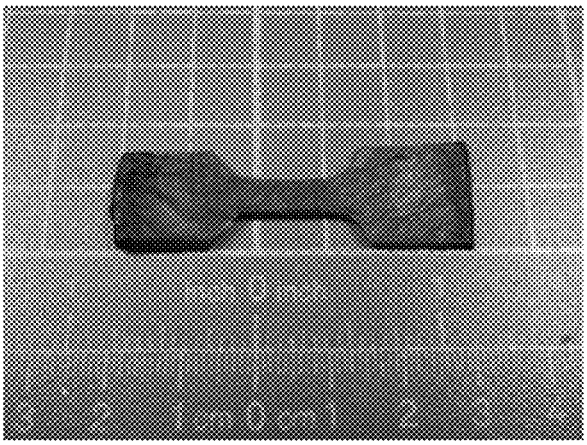
FIGS. 1A-C are photographic images of specimens (#1-10, FIG. 1A, #11-20, FIG. 1B, and #21-30 FIG. 1C) as used in the tensile strength test described below; and, FIGS. 2A-C are photographic images of specimens (#1-10, FIG. 2A, #11-20, FIG. 2B, and #21-30 FIG. 2C) as used in the suture pullout test described below.

In this document, the terms "a" or "an" are used to include one or more than one and the term "or" is used to refer to a nonexclusive "or" unless otherwise indicated. In addition, it is to be understood that the phraseology or terminology employed herein, and not otherwise defined, is for the purpose of description only and not of limitation. Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference should be considered supplementary to that of this document; for irreconcilable inconsistencies, the usage in this document controls. When a range of values is expressed, another embodiment includes from the one particular value and/or to the other particular value. Similarly, when values are expressed as approximations, by use of the antecedent "about," it will be understood that the particular value forms another embodiment. All ranges are inclusive and combinable. Further, reference to values stated in ranges includes each and every value within that range. It is also to be appreciated that certain features of the invention, which are for clarity described herein in the context of separate embodiments, may also be provided in combination in a single embodiment. Conversely, various features of the invention that are, for brevity, described in the context of a single embodiment, may also be provided separately or in any subcombination.

According to the present disclosure, an oil-infused, bacterial nanocellulose (BNC) material is described, as well as methods for forming the same. One type of bacterial cellulose that is particularly suited for the present disclosure is synthesized by the bacteria *Acetobacter xylinum* (reclassified as *Gluconacetobacter* and/or *Komagataeibacter*). The cellulose produced by this bacteria is characterized by a highly crystalline three-dimensional network consisting of pure cellulose nanofibers (i.e., cellulose fibers having a cross-sectional dimension in the nanometer range) that is stabilized by inter and intra hydrogen bonds. Such a fibrillar network displays high strength, flexibility, and large nanofiber surface area. The cellulose nanofibers define an interconnecting heterogeneous pore network with high void space (i.e., porosity) that allows for the entrapment and retention of secondary filler materials. These properties make this material ideally suited as a replacement for natural leather products, which are formed from three-dimensional networks of the protein collagen. According to certain embodiments, the bacterial nanocellulose is "pure bacterial nanocellulose" in that it is cellulose synthesized solely from bacterial sources. In other words, there are no other types of microbes, such as yeast for example, that contribute to the cellulose synthesis process or to the overall structure and appearance of the final product. In certain embodiments, the pure bacterial nanocellulose is synthesized solely from a vinegar bacteria source, for example, *Gluconacetobacter*.

According to certain embodiments, the bacterial nanocellulose fibers have a crystallinity, when measured by XRD, of at least 65%, preferably at least 80%, up to an including at least 95%. According to further embodiments, the porous body has a pore volume (i.e., porosity) of at least 75%, at least 80%, or at least 90%. According to additional embodiments, the porous body has a cellulose content in the range of about 15 mg/cm' to about 40 mg/cm', such as, for example, a range of about 20 mg/cm' to about 30 mg/cm'. Cellulose content as measured herein will be described further below.

According to the present disclosure, an oil-infused BNC material is described including a porous body of bacterial nanocellulose fibers and an oil component, where the oil component is entrapped within the pore network of the porous body. "Oil" as used herein, includes mineral oil and waxes, and natural oils, fats, and waxes derived from plants and animals, as well as synthetic derivatives thereof. Oils and waxes known to be useful in the fatliquoring processes of animal hides are considered as suitable within the present disclosure. The oil component can include compositions of pure oil, as well as a composition wherein the majority portion by weight includes an oil, or combination or mixture of oils. In certain embodiments, the oil component can include a minority portion of an emulsifying agent to assist the penetration of the oil into the porous network of the porous body. Suitable emulsifying agents can include, for example, water-miscible organic solvents, such as will be described in more detail below.

Mineral Oils and Waxes:

Mineral oils and waxes are a byproduct obtained from crude oil and typically include mixtures of many alkanes and cycloalkanes, which are separated by distillation. Mineral oils are typically immiscible with water and can provide some degree of waterproof properties. They can be available in a variety of viscosities and typically have a density lighter than water. Mineral waxes can include, for example, paraffin wax, lignite wax, and ceresine wax. This list is not meant to be exclusive.

Natural Oils, Fats, and Waxes:

Typically, most of the oils and fats in animals, fish and plants are fatty acid glycerides. These fatty acids are mostly water insoluble and range from very fluid oily liquids to greasy pastes and hard waxy materials.

Fatty acids may be classified as saturated or unsaturated. Saturated fatty acids are usually more viscous or solid, do not darken with exposure to sunlight, and can typically resist oxidation upon exposure to air and moisture. Unsaturated fatty acids are more fluid (less viscous), darken with sunlight, and can become sticky or gummy on oxidation by air.

Most naturally occurring fatty acids have an even number of C atoms. Shorter chain saturated fatty acids, such as C-6, C-8, and C-10, are found in coconut and palm oils, milk fat and other softer oils. C-12, lauric acid, is found in sperm oil. Saturated fatty acids of C-16 and C-18 are common to animal fats and many vegetable oils. The C-24 and C-25 category are found in waxes, such as carnauba wax and beeswax.

The unsaturated fatty acids, with more than 1 double bond can be classified as drying oils such as linseed or cottonseed oils. Some contain —OH groups such as lanopalmic acid (C-16 hydroxy, saturated) found in wool fat (or wool grease) and ricinoleic acid (C-18 hydroxy, unsaturated) found in castor oil.

Exemplary animal oils and fats can include: cod liver oil, herring oil, salmon oil, sardine oil, japanese fish oil, menhaden oil, whale oil (e.g., sperm oil), beef tallow, mutton tallow, wool fat and grease, stearine, stearic acid, milk fat (or butterfat), and neatsfoot oil. Exemplary vegetable oils can include: coconut oil, cottonseed oil, olive oil, palm oil, palm kernel oil, castor oil, linseed oil and soybean oil. Exemplary natural waxes can include carnauba wax, candelilla wax, and beeswax.

According to further embodiments, the porous body is fully dehydrated. As used herein, "fully dehydrated" means that the porous body contains less than 5% by weight of free water molecules, and can contain, in certain embodiments, less than 1% by weight of free water molecules. It should be appreciated that some degree of hydrogen bonding occurs in and between the nanocellulose polymer chains of the porous body, such that a percentage of water molecules can be bound via hydrogen bonding in the polymer network, and thus are not "free" as that term is understood in the art.

According to certain embodiments of the present disclosure, the porous body is "never dried" from synthesis to its final state. As used herein, "never dried" when referring to the porous body, means that at least 80%, preferably 90%, and most preferably 95% or more of the total volume of void space defined by the porous network of bacterial nanocellulose fibers is continuously occupied with a liquid, from fermentation through to the final oil-infused BNC material embodiments described herein. In certain embodiments where specified, "never-dried" refers to the porous body or the oil-infused BNC material having 95% or greater of the total volume of void space being continuously occupied with a liquid from the start of fermentation.

It should be further noted that the terms "dehydrated" and "dried" as used herein are not intended to cover the same scope. Dehydration is directed to the processes of water removal, which can under certain circumstances, include drying. Drying is directed to processes where liquid (of any type) is removed from the pores of the porous body and the pore spaces become occupied by a gas or vapor (e.g., air or $CO_2$).

The benefits of a porous body of "never-dried" bacterial nanocellulose can be relevant to potential uses in the textile industry. While cellulose-based materials have been considered for textile manufacturing, a significant drawback is that cellulose sheets can lose some of the preferred qualities when it dries. Cellulose in its native hydrated (i.e., "wet") state expresses many properties for a textile material. However, when wet cellulose is exposed to the environment, the water occupying the pore space defined by the fiber network begins to evaporate. This results in breakage of crosslinkages both from the intra-chain crosslinking in the polysaccharide chains as well as inter-chain crosslinking provided through hydrogen bonding from the water molecules in the porous network. When this loss of crosslinking occurs, the pores that were previously occupied by water collapse, which reduces available pore space as well as pore size, and inhibits access to remaining pore voids. The result is a product of densely collapsed cellulose with undesirable handling properties, along with a reduced ability to manipulate the remaining reduced pore space.

As such, unlike animal hides, which can be conditioned after drying out, the drying of a porous body comprised of bacterial nanocellulose fibers is irreversible to the extent that the porous structure collapses causing the material to thin and densify, which inhibits any subsequent attempts to infuse the material with conditioning agents. A porous body of bacterial nanocellulose that has remained in a never-dried state, when subsequently infused with oils, can become stable in a wide range of environmental conditions and has handling and mechanical properties very similar to that of animal leather. The infusion of oils, fats and waxes into a porous body of bacterial nanocelluose is not as efficiently accomplished using traditional fat liquoring techniques for animal hides. Oil-infusion of a porous body of never-dried bacterial nanocellulose, according to embodiments of the present disclosure, can create a completely natural, environmentally degradable, product with leather-like properties, durability, and appearance, with the additional benefit of eliminating the use of aggressive chemical processing, animal slaughter, and environmental contamination.

According to embodiments of the present disclosure the oil-infused BNC material can have a thickness in the range of about 1 mm to about 20 mm, for example in the range of about 1 mm to about 10 mm, for example in the range of about 1 mm to about 5 mm. According to further embodiments, the oil comprises at least 70% by weight of the total weight of the oil-infused BNC material, up to and including at least about 95%, for example in the range of about 75% to about 95%, from about 75% to about 90%, about 80% to about 95%, about 80% to about 90%, from about 80% to 85%, from about 85% to about 90%, and any subcombination of the ranges here disclosed.

According to embodiments of the present disclosure, the oil-infused BNC material has a tensile strength in the range of about 275 $N/cm^2$ to about 2100 $N/cm^2$. According to further embodiments, the oil-infused BNC material has a tensile load at failure value of about 50 N to about 150 N. According to still further embodiments, the oil-infused BNC material has a stitch pullout failure load of about 5 N to about 40 N.

According to the present disclosure, a textile or fabric material is described including the oil-infused BNC as previously detailed. In certain embodiments, the textile or fabric material comprises a single sheet of oil-infused BNC. In certain further embodiments, the textile material comprises a plurality of sheets of oil-infused BNC; in other words, a multi-layer textile material of oil-infused BNC. In certain additional embodiments, the sheet can comprise a plurality of oil-infused BNC strips, strands, or fibers or combinations thereof, that are woven or knitted or braided, or other known methods of interlacing or interconnection that are commonly known to those of skill in the art. In alternate embodiments, the oil-infused sheet is a continuous, uniform, monolithic structure.

According to the present disclosure, methods of preparing an oil-infused BNC material include

- fermenting bacteria to form a porous body of bacterial nanocellulose fibers having a three-dimensional network defining a plurality of interconnected pores;
- mechanically pressing the porous body;
- dehydrating the porous body;
- infusing the porous body with an oil infusion fluid including an oil so as entrap the oil in the pores of the porous body so as to form an oil-infused BNC material; and,
- drying the oil-infused BNC material.

Growing the Cellulose Pellicle

In preparing the oil-infused BNC material of the present disclosure, bacterial cells (in this case *Gluconacetobacter xylinus* (*Acetobacter xylinum*)) are cultured/incubated in a bioreactor containing a liquid nutrient medium. Variations to liquid nutrient medium can affect the resultant quality and quantity of cellulose produced from the cultured bacteria. Culture media for the growth of the cellulose typically includes a sugar source and a nitrogen source, as well as additional nutrient additives. Suitable sugar sources can include both monosaccharides such as glucose, fructose, and galactose, as well as disaccharides, such as sucrose and maltose, and any combinations thereof. Suitable nitrogen sources can include ammonium salts and amino acids. Corn steep liquor is a preferred culture media component that provides both the nitrogen source as well as additional desirable additives including vitamins and minerals. Suitable nutrient additives can additionally include, for example, sodium phosphate, magnesium sulfate, citric acid, and acetic acid.

Increasing the total sugar content of the media can result in higher quantity of cellulose produced. Modifying the type of sugars added, or where multiple sugars are added, their respective ratios, can also cause changes to the resultant cellulose yields. For example, a sugar source blend including glucose and fructose can have, according to one embodiment, a higher glucose to fructose ratio, which can result in a lower strength cellulose material. Alternatively, according to another embodiment, a higher fructose to glucose ratio can result in a cellulose material exhibiting higher strength. In a further embodiment, increasing the amount of the nitrogen source can increase the quantity of cellulose produced.

In certain embodiments, the culture media is kept at an acidic pH, for example at around 4.0-4.5. Increasing the media pH above 5.0 or greater can, in certain situations, result in reduced bacterial cell growth. In certain embodiments, the temperature of the culture media is kept above room temperature, for example in the range of about greater than 25° C. to about 35° C. In a preferred embodiment, the culture media is in the range of about 30° C. Adjustments to the incubation temperature can in certain instances affect the growth of the cellulose materials. Increasing the incubation temperature can, according to one embodiment, increase the amount of cellulose yielded. Alternatively, lowering the incubation temperature can decrease the amount of cellulose material yielded. According to one embodiment, the bacterial cells are cultured for approximately 1-4 days prior to beginning the fermentation process.

Once the appropriate amount of bacteria has been propagated, the fermentation process begins. The cultured media is typically poured into bioreactor trays to begin the fermentation process. According to certain embodiments, the higher the amount of bacterial cells in the culture media results in a higher quantity of cellulose produced. According to certain embodiments, the fill weight of the culture media is in the range of about 1.5 L to about 15 L, for example in the range of about 4 L to about 8 L, or about 5 L to about 10 L. The fermentation process is typically carried out in a shallow bioreactor with a lid which reduces evaporation. Such systems are able to provide oxygen-limiting conditions that help ensure formation of a uniform cellulose pellicle. Dimensions of the bioreactor can vary depending on the desired shape, size, thickness and yield of the cellulose being synthesized.

In a preferred embodiment, the fermentation process occurs at around 30±2° C. in an acidic environment having a pH of about 4.1 to about 4.6 under static conditions for about 5 days to 30 days.

In certain embodiments, the fermentation step can occur in the temperature range of about 20° C. to about 40° C., such as, for example, 20° C. to 30° C., 30° C. to 40° C., 25° C. to 35° C., 28° C. to 32° C., 28° C. to 30° C., and 30° C. to 32° C. In a preferred embodiment, fermentation occurs in the range of 28° C. to 32° C., and more particularly preferred at about 30° C.

The fermentation can occur in at an acidic pH, for example in the range of about 3.3 to about 7.0, such as for example in the range of about 3.5 to about 6.0, or 4.0 to about 5.0. In a preferred embodiment, the fermentation occurs at a pH range of about 4.1 to about 4.6.

The time period for fermentation can vary. According to embodiments of the present disclosure, fermentation can occur from about 5 days to about 60 days depending upon the desired growth of the cellulose pellicle. For example, fermentation can occur from about 5 days to about 10 days, from about 5 days to about 30 days, from about 10 days to about 50 days, from about 10 days to about 25 days, from about 20 days to about 60 days, from about 20 days to about 50 days, and from about 20 days to about 30 days, as well combinations of ranges falling within the ranges stated herein. According to certain embodiments, a longer fermentation results in a higher amount of cellulose produced, while alternatively, a reduced fermentation time results in a lower amount of cellulose produced. Depending on the desired thickness and/or cellulose yield, the fermentation can be stopped, at which point the cellulose pellicle (i.e, porous body of cellulose) can be harvested from the fermentation tray bioreactor.

Cellulose Purification

After completion of fermentation and harvesting, according to certain embodiments, the porous body of nanocellulose can undergo a purification process where the porous body is rendered free of microbes; i.e., the porous body is chemically treated to remove bacterial by-products and residual media. A caustic solution, preferably sodium hydroxide, at a preferable concentration in the range of about 0.1M to 4M, is used to remove any viable organisms and pyrogens (endotoxins) produced during fermentation from the porous body. Processing times in sodium hydroxide of about 1 to about 12 hours have been studied in conjunction with temperature variations of about 30° C. to about 100° C. to optimize the process. A preferred or recommended temperature processing occurs at or near 70° C. The treated porous body can be rinsed with filtered water to reduce microbial contamination (bioburden) and achieve a neutral pH. In addition, the porous body can be treated with a dilute acetic acid solution to neutralize remaining sodium hydroxide.

According to further embodiments of the present disclosure, after harvesting, the porous body can undergo one or more mechanical pressings (either prior to or after purification where utilized) to remove excess water, reduce the overall thickness, and increase the cellulose density of the porous body. Where desired, according to certain embodiments, the porous body may be additionally processed through thermal modification via freezing and dehydration at a range of about −5° C. to −80° C. for about 1-30 days, which can further decrease thickness and increase cellulose density.

Solvent Dehydration of the Porous Body

According to further embodiments of the disclosure, after harvesting of the cellulose pellicle, most frequently after an initial mechanical press of the porous body to physically remove a bulk quantity of water and compress the thickness, the porous body can be processed with a water-miscible organic solvent for one to up to several cycles to further dehydrate the porous body. If desired the porous body can undergo further mechanical pressing after completion of the solvent exchange dehydration step.

Exemplary water-miscible organic solvents can include, for example, acetaldehyde, acetic acid, acetone, acetonitrile, 1,2-butanediol, 1,3-butanediol, 1,4-butanediol, 2-butoxyethanol, butyric acid, diethanolamine, diethylenetriamine, dimethylformamide, dimethoxyethane, dimethyl sulfoxide, 1,4-dioxane, ethanol, ethylamine, ethylene glycol, formic acid, furfuryl alcohol, glycerol, methanol, methyl diethanolamine, methyl isocyanide, N-methyl-2-pyrrolidone, 1-propanol, 1,3-propanediol, 1,5-pentanediol, 2-propanol, propanoic acid, propylene glycol, pyridine, tetrahydrofuran, and triethylene glycol. A preferred list of solvents includes methanol, ethanol, propanol, isopropanol, acetone and mixtures thereof.

According to certain embodiments, the porous body is immersed in the solvent. According to further embodiments, the porous body can undergo one or more solvent exchanges during processing to increase dehydration of the porous body. For example, the porous body can be immersed in one, two, three, four, five, up to about 10 solvent exchanges during solvent dehydration. According to certain embodiments, the solvent can be heated substantially near, or at, its boiling point during the solvent dehydration process. In a preferred embodiment, the solvent is in a boiling state during the entire dehydration process. According to still further embodiments, the weight to volume (mg/mL) ratio of the cellulose nanofibers to solvent can be in the range of 15:1 or less, 12:1 or less, 10:1 or less, or 8:1 or less. In further embodiments, the solvent is mechanically agitated during the process, for example with a magnetic stirring device or other known processes. As previously noted, after completion of the solvent exchange dehydration process, the porous body can once again undergo one or more mechanical pressings to remove excess solvent or achieve a desired thickness.

Supercritical Carbon Dioxide Drying

Alternatively to, or in conjunction with, the solvent dehydration steps described above, the porous body can be further dehydrated by critical point drying utilizing supercritical carbon dioxide. During critical point drying, the wet porous body (either having water or solvent, or both entrapped within the pores) is loaded onto a holder, sandwiched between stainless steel mesh plates, and then soaked in a chamber containing supercritical carbon dioxide under pressure. The holder is designed to allow the $CO_2$ to circulate through the porous network while mesh plates stabilize the porous body to prevent it from deforming during the drying process. Once all of the solvent (or water) has been exchanged (which in most typical cases is in the range of about 1-6 hours), the temperature in the chamber is increased above the critical temperature for carbon dioxide so that the $CO_2$ forms a supercritical fluid/gas. Due to the fact that no surface tension exists during such transition, the resulting product is a dehydrated and dried porous body which maintains its shape, thickness and 3-D nanostructure. According to the present disclosure, the resultant porous body can be referred to as "critically dried."

Oil Infusion Process

According to the present disclosure, after dehydration of the porous body via either solvent or supercritical drying, or both, the porous body can be subjected to one or more oil infusion steps to allow the oil component to penetrate the porous body and become entrapped within the pore network so as to form an oil-infused BNC material. Typically, the porous body is completely submerged in a container containing an oil infusion fluid including the oil. In embodiments where the porous body is submerged in the oil infusion fluid, the ratio in weight to volume (mg/ml) of nanocellulose fibers to oil infusion fluid is less than about 15:1 to about 1:1, such as for example, 12:1, 10:1, 8:1, 5:1, 4:1, 3:1, 2:1, and combinations and subranges of each of the preceding ratios. Alternatively, the oil infusion fluid can be applied and pressed into the porous body, such as for example, with the use of rollers, brushers, or pads.

According to certain embodiments, the oil infusion fluid includes only the oil component. Alternatively, the oil infusion fluid can include the oil component combined with an emulsifier to promote the infusion of the oil component into the porous body. In certain embodiments, and oil infusion fluid having an emulsifier and an oil can increase the total amount of oil entrapped in the final oil-infused BNC material. Suitable emulsifying agents can include, for example, the water-miscible organic solvents previously disclosed as suitable for the solvent dehydration process. According to certain embodiments, the oil infusion fluid can be prepared to have an oil to emulsifier ratio by volume in the range of about 90:10 to about 10:90 and any subrange therein, for example 80:20, 70:30, 60:40, 50:50, 40:60, 30:70, and 20:80. In certain embodiments, a higher ratio of oil to emulsifier can result in a higher concentration of entrapped oil in the final oil-infused BNC material. According to still further embodiments, the oil infusion fluid can be heated during the oil-infusion process. One benefit to heating the oil infusion fluid is to ensure that any of the heavier oil components that have a melting point higher than ambient temperature can melt, or at least have a reduced viscosity to assist the formation of a suitable emulsion. According to one embodiment, the oil infusion fluid is heated to boiling. According to still another embodiment, the oil infusion fluid is constantly agitated or otherwise mixed during the infusion process. Agitation is beneficial to ensuring homogeneity within the oil infusion fluid, such as for example, where one or more oils are present in the oil component, or where the oil component is combined with an emulsifier. Agitation can further promote the penetration of the oil infusion fluid into the porous network of the porous body.

Post Infusion Treatment

According to further embodiments of the disclosure, the oil-infused BNC material can undergo further processing. For example, the oil-infused BNC material can be dried to remove any residual water or solvents still remaining within the pore network. In certain embodiments, the drying can be done in an air oven and can further include tumble drying. The oil-infused BNC can be further processed to impart aesthetic qualities such as dying and or surface treatments to alter the texture of the surface or to add a design or pattern to the surface. Additionally, the oil-infused BNC material can be mechanically pressed to reach a final desired thickness or weight, or to remove any excess oil from the final BNC material. According to still further embodiments, the oil-infused BNC material can undergo a sealing or finishing step that aids in retaining the oil within the pore network.

EXAMPLES

Cellulose Preparation

A strain of *Gluconacetobacter* (*Komagataeibacter*) was cultured in sucrose and corn-steep liquor based media (including an autoclave step) and 7.2 L (4.2 L of media+3 L of inoculum) was poured into a stationary reactor tray for fermentation. Fermentation lasted for 26 days at a temperature of approximately 31° C. at a pH in the range of 4.1-4.6. At harvest, the pellicle had an average thickness of approximately 5 cm and weighed 5.605 kg. The porous body (i.e., pellicle) formed at the surface had the aesthetic and tactile properties observed in natural leather hides. The porous body was purified by washing with 1-6% aqueous NaOH and bleached with 0.1-1% $H_2O_2$, followed by soaking in distilled/purified water to obtain a neutral pH. Finally, the porous body was mechanically pressed to desired thicknesses. The weight of the water infused porous body after purification and pressing was 230.96 g and the porous body had an average cellulose content of approximately 22.9 mg/cm$^2$. Cellulose content was measured by taking a sample of the wet porous body with a known area and air drying for approximately 12 hrs at 55° C. which resulted in a porous body that theoretically includes only the nanocellulose fibers. In other words, the total weight of the dried porous body was completely due to the nanocellulose fibers. Cellulose content was measured by dividing the weight of the dried sample by its area.

Solvent Extraction

The wet pressed porous body was then cut into 45 strips, each approximately 5 cm×5 cm and each having a cellulose content of approximately 575 mg (i.e., 22.9 mg/cm$^2$). The wet strips were measured for thickness at each of their four corners and their average wet thickness was recorded in the table below. The strips were then randomly divided into 3 groups of 10 samples each and were processed through a solvent extraction step and an oil infusion step. The solvent extraction for the samples was the same and included a multistep extraction using boiling ethyl alcohol [ETOH] (approx. 70° C.) having 99% purity. The samples were placed in a flask with a mechanical stirrer operating at approximately 200 rpm and containing about 1500 mL of ETOH for about 2 hours to 24 hours. A second extraction step was done separately with each of the 10 samples from Group 1, 2, and 3, respectively with 500 mL of boiling ETOH, including a stirrer at 200 rpm for about 2 hours to 24 hours. After the samples were removed from the solvent extraction, they were weighed and prepared for the oil infusion step. The weight of the samples after the solvent wash is recorded in the table below as "Wash wt."

Oil Infusion

Group 1 samples (samples 1-10) were placed in a flask containing a heated oil infusion fluid at about 70° C. under constant mixing. The oil infusion fluid contained 250 mL of ETOH as an emulsifier and 250 ml of unrefined coconut oil (a 50:50 emulsifier/oil ratio). Group 2 samples (samples 11-20) were placed in a flask containing a heated oil infusion fluid at about 70° C. under constant mixing. The oil infusion fluid contained 350 mL of ETOH as an emulsifier and 150 ml of unrefined coconut oil (a 70:30 emulsifier/oil ratio). Group 3 samples (samples 21-30) were placed in a flask containing a heated oil infusion fluid at about 70° C. under constant mixing. The oil infusion fluid contained 150 mL of ETOH as an emulsifier and 350 ml of unrefined coconut oil (a 30:70 emulsifier/oil ratio). Each group of samples underwent oil-infusion for approximately 2 hours. After the oil infusion process was complete, the samples were weighed to record their weight, shown in the table below as "Infusion wt." The samples were air dried for approximately 24 hours in a fume hood and their dry weight and average thickness was recorded. The oil weight and oil percent of the final dried product were calculated by subtracting the known cellulose weight of the sample (approximately 575 mg) from the total dry weight of the oil-infused BNC material. Below are tables for Groups 1-3 showing the measured weights and thicknesses of the samples from the solvent wash stage through to drying.

TABLE 1

| Group 1 (50:50 infusion) | | | | | | | |
|---|---|---|---|---|---|---|---|
| Sample | Wash wt. (g) | Infusion wt. (g) | Avg. wet thick (mm) | Avg. dry thick (mm) | Dry wt. (g) | Oil wt. (g) | Oil % |
| 1 | 22.29 | 22.32 | 9.24 | 2.15 | 4.218 | 3.643 | 86.37% |
| 2 | 14.44 | 14.12 | 5.45 | 1.76 | 3.5335 | 2.9585 | 83.73% |
| 3 | 11.75 | 11.96 | 3.99 | 1.556 | 3.4435 | 2.8685 | 83.30% |

TABLE 1-continued

| Group 1 (50:50 infusion) | | | | | | | |
|---|---|---|---|---|---|---|---|
| Sample | Wash wt. (g) | Infusion wt. (g) | Avg. wet thick (mm) | Avg. dry thick (mm) | Dry wt. (g) | Oil wt. (g) | Oil % |
| 4 | 29.41 | 32.80 | 12.48 | 2.86 | 5.2030 | 4.628 | 88.95% |
| 5 | 20.58 | 19.72 | 6.14 | 1.68 | 4.0391 | 3.4641 | 85.76% |
| 6 | 17.20 | 15.73 | 5.22 | 1.58 | 3.5908 | 3.0158 | 83.99% |
| 7 | 10.46 | 10.29 | 6.26 | 1.94 | 3.7979 | 3.2229 | 84.86% |
| 8 | 18.08 | 17.90 | 3.39 | 1.20 | 2.8406 | 2.2656 | 79.76% |
| 9 | 19.44 | 19.03 | 6.86 | 1.67 | 3.8671 | 3.2921 | 85.13% |
| 10 | 11.35 | 10.38 | 3.54 | 1.16 | 2.7786 | 2.2036 | 79.31% |
| Avg. | 17.50 | 17.43 | 6.26 | 1.76 | 3.7312 | 3.1562 | 84.59% |

TABLE 2

| Group 2 (70:30 infusion) | | | | | | | |
|---|---|---|---|---|---|---|---|
| Sample | Wash wt. (g) | Infusion wt. (g) | Avg. wet thick (mm) | Avg. dry thick (mm) | Dry wt. (g) | Oil wt. (g) | Oil % |
| 11 | 19.24 | 19.20 | 8.27 | 1.53 | 2.9612 | 2.3862 | 80.58% |
| 12 | 11.05 | 10.90 | 4.51 | 1.17 | 2.4602 | 1.8852 | 76.63% |
| 13 | 24.06 | 23.50 | 10.10 | 2.12 | 4.1119 | 3.5369 | 86.02% |
| 14 | 20.28 | 21.44 | 9.42 | 2.07 | 3.6603 | 3.0853 | 84.29% |
| 15 | 15.38 | 15.94 | 6.85 | 1.52 | 3.4748 | 2.8998 | 83.45% |
| 16 | 17.74 | 18.550 | 6.85 | 1.54 | 3.3634 | 2.7884 | 82.90% |
| 17 | 14.55 | 14.63 | 5.42 | 1.41 | 3.4451 | 2.8701 | 83.31% |
| 18 | 13.51 | 13.30 | 5.66 | 1.20 | 2.8942 | 2.3192 | 80.13% |
| 19 | 22.13 | 22.70 | 8.22 | 1.69 | 3.9346 | 3.3596 | 85.39% |
| 20 | 15.47 | 14.88 | 4.89 | 1.30 | 3.3346 | 2.7596 | 82.76% |
| Avg. | 17.34 | 17.50 | 7.02 | 1.56 | 3.3640 | 2.789 | 82.91% |

TABLE 3

| Group 3 (30:70 infusion) | | | | | | | |
|---|---|---|---|---|---|---|---|
| Sample | Wash wt. (g) | Infusion wt. (g) | Avg. wet thick (mm) | Avg. dry thick (mm) | Dry wt. (g) | Oil wt. (g) | Oil % |
| 21 | 34.92 | 41.28 | 16.02 | 3.80 | 5.9028 | 5.3278 | 90.26% |
| 22 | 24.72 | 24.09 | 10.83 | 3.59 | 7.5636 | 6.9886 | 92.40% |
| 23 | 13.19 | 12.37 | 5.62 | 2.33 | 4.7619 | 4.1869 | 87.92% |
| 24 | 14.89 | 14.90 | 7.04 | 2.72 | 7.0074 | 6.4324 | 91.79% |
| 25 | 32.71 | 38.83 | 16.34 | 4.33 | 9.8114 | 9.2364 | 94.14% |
| 26 | 17.87 | 17.40 | 8.20 | 3.27 | 7.4616 | 6.8866 | 92.29% |
| 27 | 24.64 | 25.17 | 12.34 | 3.86 | 8.2823 | 7.7073 | 93.06% |
| 28 | 33.19 | 36.53 | 15.14 | 3.99 | 10.0162 | 9.4412 | 94.26% |
| 29 | 33.42 | 36.17 | 13.26 | 3.32 | 8.6362 | 8.0612 | 93.34% |
| 30 | 19.44 | 19.45 | 7.49 | 2.48 | 6.8695 | 6.2945 | 91.63% |
| Avg. | 24.90 | 26.62 | 11.23 | 3.37 | 7.6313 | 7.0563 | 92.47% |

The oil-infused BNC material samples were further tested for tensile strength and stitch pullout to assess their suitability as a textile material.

Tensile Strength

Figure 1B:
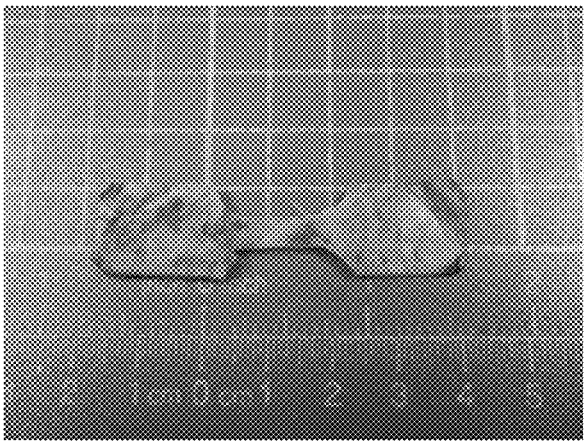
Figure 1C:
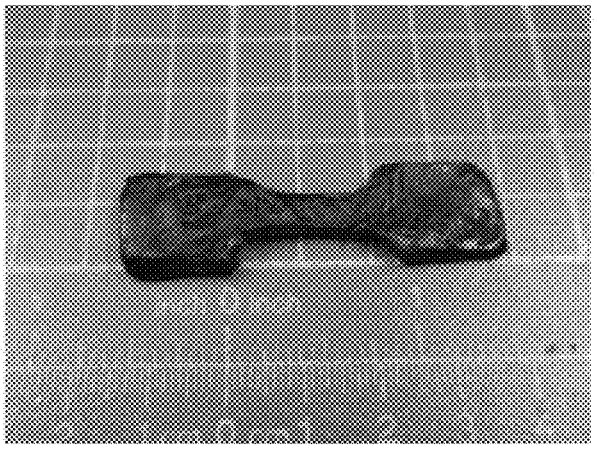

The samples were tested on a MTS Insight 100 (EM05) with a 250N load cell capacity and set at 50 mm/min. As can be seen in FIGS. 1A-C, the shapes of the specimens for each of Groups 1-3 were modified for the test to approximately 5 cm×1.5 cm, with an approximate barbell shape having a central cutout section approximately 2 cm in length and 4-5 mm in width. Samples were placed in the instrument grips and tensile load and displacement length were recorded to failure. Measured values for each of Groups 1-3 are shown in the below tables. "Tensile Load" is a measurement of the force at failure in Newtons. "Tensile Strength" is a measurement of the Tensile Load at failure divided by the cross-sectional area of the specimen (thickness×width).

TABLE 4

| Group 1 Results: | | | | | |
|---|---|---|---|---|---|
| Group 1 Specimen | Thickness (mm) | Width (mm) | Tensile Load (N) | Displacement @ Failure (mm) | Tensile Strength (N/cm$^2$) |
| 1 | 1.62 | 4.49 | 84.5 | 3.04 | 1160 |
| 2a | 1.60 | 4.42 | 124 | 4.21 | 1750 |
| 2b | 1.60 | 4.42 | 147 | 1.42 | 2080 |
| 3 | 1.17 | 4.90 | 51.9 | 2.80 | 905 |
| 4 | 1.88 | 4.55 | 107 | 4.89 | 1250 |

**5 (N/T)

TABLE 4-continued

| Group 1 Results: | | | | | |
|---|---|---|---|---|---|
| Group 1 Specimen | Thickness (mm) | Width (mm) | Tensile Load (N) | Displacement @ Failure (mm) | Tensile Strength (N/cm$^2$) |
| 6 | 1.12 | 4.90 | 109 | 2.98 | 1980 |
| 7 | 1.30 | 4.78 | 73.5 | 4.39 | 1180 |
| 8 | 0.99 | 5.60 | 77.7 | 4.23 | 1400 |
| 9 | 1.40 | 5.33 | 102 | 2.91 | 1360 |
| 10 | 1.12 | 4.66 | 106 | 4.26 | 2020 |
| Mean | 1.36 | 4.85 | 95.4 | 3.44 | 1480 |
| Std Dev | 0.293 | 0.394 | 27.3 | 1.09 | 433 |

**Specimen 5 was not tested for tensile properties

TABLE 5

| Group 2 Results: | | | | | |
|---|---|---|---|---|---|
| Group 2 Specimen | Thickness (mm) | Width (mm) | Tensile Load (N) | Displacement @ Failure (mm) | Tensile Strength (N/cm$^2$) |
| 11a | 1.18 | 4.72 | 104 | 4.377 | 1870 |
| 11b | 1.18 | 4.72 | 113 | 1.15 | 2020 |
| 12 | 1.10 | 4.88 | 93.5 | 3.00 | 1740 |
| 13 | 1.72 | 5.69 | 82.1 | 6.23 | 839 |
| 14 | 1.67 | 4.98 | 119 | 6.22 | 1430 |
| 15 | 1.21 | 5.03 | 59.2 | 4.58 | 973 |
| 16 | 1.30 | 4.11 | 81.8 | 4.66 | 1530 |
| 17 | 1.44 | 5.10 | 67.3 | 5.95 | 925 |
| 18 | 1.09 | 4.10 | 117.4 | 4.10 | 2630 |
| 19 | 1.38 | 4.40 | 77.0 | 5.04 | 1270 |
| 20 | 1.27 | 3.82 | 94.5 | 5.17 | 1950 |
| Mean | 1.32 | 4.69 | 91.71 | 4.59 | 1561.55 |
| std. Dev. | 0.21 | 0.54 | 20.20 | 1.50 | 548.33 |

TABLE 6

| Group 3 Results | | | | | |
|---|---|---|---|---|---|
| Group 3 Specimen | Thickness (mm) | Width (mm) | Tensile Load (N) | Displacement @ Failure (mm) | Tensile Strength (N/cm$^2$) |
| 21 | 2.22 | 5.36 | 89.2 | 8.59 | 750 |
| 22 | 2.24 | 5.30 | 71.0 | 7.10 | 598 |
| 23a | 2.16 | 5.68 | 79.4 | 4.04 | 647 |
| 23b | 2.16 | 5.68 | 89.5 | 1.31 | 730 |
| 24a | 2.16 | 5.88 | 80.9 | 3.10 | 637 |
| 24b | 2.16 | 5.88 | 69.1 | 5.02 | 544 |
| 24c | 2.16 | 5.88 | 108 | 1.38 | 847 |
| 25 | 4.01 | 6.08 | 69.8 | 7.88 | 286 |
| 26 | 3.30 | 5.70 | 79.4 | 9.68 | 422 |
| 27a | 2.79 | 4.80 | 82.8 | 5.35 | 618 |
| 27b | 2.79 | 4.80 | 66.3 | 0.411 | 495 |
| 28 | 3.49 | 5.08 | 59.0 | 6.01 | 332 |
| 29 | 4.06 | 5.78 | 69.6 | 5.97 | 297 |
| 30 | 2.63 | 5.70 | 95.3 | 4.14 | 636 |
| Mean | 2.74 | 5.54 | 79.24 | 5.00 | 528.11 |
| Std Dev. | 0.70 | 0.41 | 13.11 | 2.81 | 220.72 |

Stitch/Suture Pullout

Figure 2A:
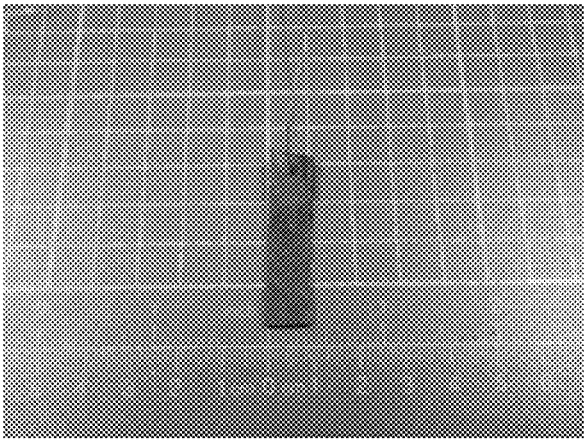
Figure 2B:
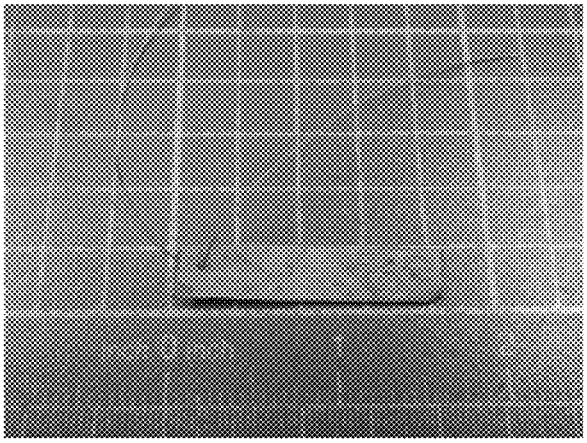
Figure 2C:
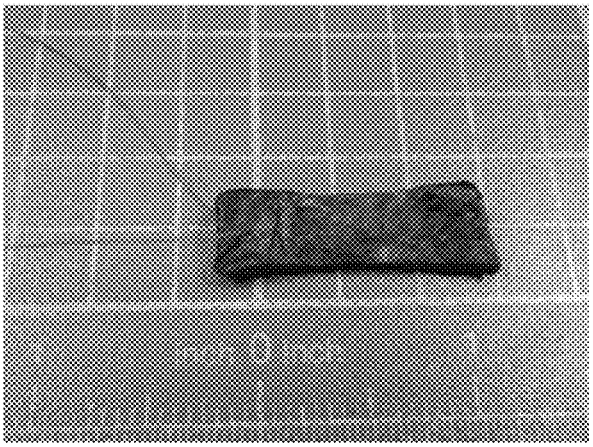

The samples were tested on a MTS Insight 100 (EM05) with a 250N load cell capacity and set at 300 mm/min setting. As can be seen in FIGS. 2A-C, the shapes of the specimens for each of Groups 1-3 were modified for the test to approximately 4 cm×1.0 cm, with a stitch placed at one end approximately 0.5 cm from each border. The sample was placed in one grip and the excess stitch length was grasped in the other grip. The instrument was activated and sample displacement distance and load at failure were recorded and the values are shown in the table below.

TABLE 7

| Group 1 Results | | |
|---|---|---|
| Specimen # | Pull-Out Load (N) | Displacement @ Pull-Out (mm) |
| 1 | 22.4 | 2.69 |
| 2 | 13.3 | 2.34 |
| 3 | 13.1 | 2.80 |
| 4 | N/T | N/T |
| 5 | 15.5 | 1.15 |
| 6 | N/T | N/T |
| 7 | 14.8 | 2.05 |
| 8 | 7.4 | 3.38 |
| 9 | 12.0 | 1.07 |
| 10 | 18.1 | 1.89 |
| Mean | 14.6 | 2.17 |
| Std. Dev. | 4 42 | 0 802 |

TABLE 8

| Group 2 Results | | |
|---|---|---|
| Specimen # | Pull-Out Load (N) | Displacement @ Pull-Out (mm) |
| 11 | 14.4 | 1.10 |
| 12 | 13.6 | 1.98 |
| 13 | 28.5 | 3.62 |
| 14 | 15.2 | 1.56 |
| 15 | 13.7 | 2.74 |
| 16 | 17.1 | 2.92 |
| 17 | 16.3 | 2.54 |
| 18 | 13.4 | 2.32 |
| 19 | 16.3 | 1.20 |
| 20 | 17.2 | 2.00 |
| Mean | 16.6 | 2.20 |
| Std. Dev. | 4.43 | 0.793 |

TABLE 9

| Group 3 Results | | |
|---|---|---|
| Specimen # | Pull-Out Load (N) | Displacement @ Pull-Out (mm) |
| 21 | 26.9 | 4.82 |
| 22 | 13.5 | 3.37 |
| 23 | 21.8 | 1.91 |
| 24 | 21.4 | 2.31 |
| 25 | 11.1 | 1.33 |
| 26 | 19.2 | 1.12 |
| 27 | N/T | N/T |
| 28 | 20.8 | 4.41 |
| 29 | 36.4 | 4.99 |
| 30 | 15.2 | 2.51 |
| Mean | 20.7 | 2.97 |
| Std. Dev. | 7.60 | 1.48 |

Although the present disclosure has been described in accordance with several embodiments, it should be understood that various changes, substitutions, and alterations can be made herein without departing from the spirit and scope of the present disclosure, for instance as indicated by the appended claims. Thus, it should be appreciated that the scope of the present disclosure is not intended to be limited to the particular embodiments of the process, manufacture, composition of matter, methods and steps described herein. For instance, the various features as described above in accordance with one embodiment can be incorporated into the other embodiments unless indicated otherwise. Furthermore, as one of ordinary skill in the art will readily appreciate from the present disclosure, processes, manufacture, composition of matter, methods, or steps, presently existing or later to be developed that perform substantially the same function or achieve substantially the same result as the corresponding embodiments described herein may be utilized according to the present disclosure.

The invention claimed is:

1. An oil-infused bacterial nanocellulose (BNC) material comprising:

a porous body comprising a three-dimensional network of pure, never-dried bacterial nanocellulose fibers, the nanocellulose fiber network defining a plurality of interconnected pores; and, an oil infused within the plurality of pores, wherein the oil by weight is selected from at least 70% of the total weight of the oil-infused BNC material.

2. The oil-infused BNC material of claim 1, wherein the porous body is fully dehydrated.

3. The oil-infused BNC material of claim 1, wherein the nanocellulose fibers have a crystallinity as measured by X-ray diffraction (XRD) of at least 65%.

4. The oil-infused BNC material of claim 1, wherein the porous body has a cellulose content in the range of about 15 $mg/cm^2$ to about 40 $mg/cm^2$.

5. The oil-infused BNC material of claim 1, wherein the oil-infused BNC material has a thickness in the range of about 1 mm to about 10 mm.

6. The oil-infused BNC material of claim 1, wherein the oil is about 75% to about 95% by weight of the total weight of the oil-infused BNC material.

7. The oil-infused BNC material of claim 1, wherein the oil is about 70% to about 95% by weight of the total weight of the oil-infused BNC material.

8. The oil-infused BNC material of claim 1, wherein the oil-infused BNC material has a tensile strength in the range of about 275 $N/cm^2$ to about 2100 $N/cm^2$.

9. The oil-infused BNC material of claim 1, wherein the oil-infused BNC material has a tensile load at failure value in the range of about 50 N to about 150 N.

10. The oil-infused BNC material of claim 1, wherein the oil-infused BNC material has a stitch pullout failure load in the range of about 5 N to about 40 N.

11. The oil-infused BNC material of claim 1, further comprising one or more dyes or sealing agents.

12. A textile material comprising:

an oil-infused bacterial nanocellulose (BNC) material, the BNC material comprising a porous body comprising a three-dimensional network of pure, never-dried bacterial nanocellulose fibers, the nanocellulose fiber network defining a plurality of interconnected pores; and, an oil infused within the plurality of pores, wherein the oil by weight is selected from at least 70% of the total weight of the oil-infused BNC material.

13. The textile material of claim 12, wherein the textile material comprises a single sheet of oil-infused BNC material.

14. The textile material of claim 12, wherein the textile material comprises a plurality of sheets of oil-infused BNC material.

15. The textile material of claim 12, wherein the textile material comprises a plurality of oil-infused BNC material in the form of strips, strands, or fibers, or a combination thereof, and wherein each of the strips, strands, or fibers, or combinations thereof are interconnected or interlaced to another of the strips, strands, fibers, or combinations thereof.

16. A method of preparing an oil-infused bacterial nanocellulose (BNC) material comprising:

fermenting bacteria to form a porous body of bacterial nanocellulose fibers having a three-dimensional network defining a plurality of interconnected pores;

mechanically pressing the porous body;

dehydrating the porous body; and, infusing the porous body with an oil infusion fluid including an oil so as to entrap the oil in the pores of the porous body and to form an oil-infused BNC material, wherein the oil by weight is selected from at least 70% of the total weight of the oil-infused BNC material.

17. The method of claim 16, wherein the fermentation step includes fermenting at a temperature in the range of about 30±2° C.

18. The method of claim 16, wherein the fermentation step occurs in a pH range of about 4.1 to about 4.6.

19. The method of claim 16, wherein the fermentation step includes fermenting for a time period in the range of about 5 days to about 30 days.

20. The method of claim 16, further comprising purifying the porous body after fermentation.

21. The method of claim 16, wherein dehydrating the porous body comprises using a solvent including one or more water-miscible organic solvents.

22. The method of claim 21, wherein the solvent is heated to boiling.

23. The method of claim 21, wherein the weight to volume ratio in mg/ml of the nanocellulose fibers to the solvent is in the range of about 15:1 to about 8:1.

24. The method of claim 16, wherein the oil infusion fluid is heated during the infusion step.

25. The method of claim 16, wherein the weight to volume ratio in mg/ml of the nanocellulose fibers to the oil infusion fluid is in the range of about 15:1 to about 1:1.

26. The method of claim 16, wherein the oil infusion further fluid includes an emulsifier.

27. The method of claim 26, wherein the emulsifier is a water-miscible organic solvent.

28. The method of claim 26, wherein the oil infusion fluid has an oil to emulsifier ratio by volume in the range of about 90:10 to about 10:90.

29. The method of claim 16, further comprising dying the oil-infused BNC material.

* * * * *